US010208422B2

(12) United States Patent
Edwards et al.

(10) Patent No.: US 10,208,422 B2
(45) Date of Patent: Feb. 19, 2019

(54) LAUNDRY STAIN REMOVAL DEVICE

(71) Applicant: MONOSOL, LLC, Merrillville, IN (US)

(72) Inventors: David Brian Edwards, Old Town Stevenage (GB); Tara Sophia Edwards, Old Town Stevenage (GB)

(73) Assignee: MONOSOL, LLC, Merrillville, IN (US)

( * ) Notice: Subject to any disclaimer, the term of this patent is extended or adjusted under 35 U.S.C. 154(b) by 131 days.

(21) Appl. No.: 14/739,675

(22) Filed: Jun. 15, 2015

(65) Prior Publication Data

US 2016/0362828 A1 Dec. 15, 2016

(51) Int. Cl.

| | |
|---|---|
| ***D06F 39/02*** | (2006.01) |
| *A47L 25/08* | (2006.01) |
| *D06F 43/00* | (2006.01) |

(52) U.S. Cl.

CPC ..... *D06F 39/024* (2013.01); *A47L 25/08* (2013.01); *D06F 43/002* (2013.01)

(58) Field of Classification Search

CPC ..... D06F 39/024; D06F 43/002; A47L 25/08
USPC ..... 68/235 R
See application file for complete search history.

(56) References Cited

U.S. PATENT DOCUMENTS

| | | | |
|---|---|---|---|
| 5,040,311 | A | 8/1991 | Roy |
| 5,768,917 | A | 6/1998 | Freida |
| D396,904 | S | 8/1998 | Leu |
| 5,978,994 | A | 11/1999 | Anderson |
| 6,010,540 | A | 1/2000 | Telesca et al. |

(Continued)

FOREIGN PATENT DOCUMENTS

| | | | |
|---|---|---|---|
| EP | 2465995 | A1 | 6/2012 |
| WO | WO-03074775 | A2 | 9/2003 |

(Continued)

OTHER PUBLICATIONS

International Search Report and Written Opinion of the International Searching Authority for International Application No. PCT/US2016/037502, dated Sep. 12, 2016.

(Continued)

*Primary Examiner* — Michael E Barr
*Assistant Examiner* — Tinsae B Ayalew
(74) *Attorney, Agent, or Firm* — Marshall, Gerstein & Borun LLP

(57) ABSTRACT

A stain removal device adapted to at least partially surround a stain located on a fabric to activate in a targeted manner includes a shell comprising a wall with an inner surface, an outer surface, a rim defining an aperture in the shell, the rim being defined by the inner and outer surfaces and the inner surface defining a shell cavity, at least one opening extending through the wall of the shell between the inner and outer surfaces of the shell, a dispensable cleaning agent at least partially disposed within the shell cavity, and an attachment portion at least partly coupled to the shell. The attachment portion is configured to removably couple the stain removal device to a fabric or article of clothing such that the rim of the shell contacts the fabric and at least partially surrounds a stain located on the fabric. So configured, the dispensable cleaning agent may activate in a targeted manner relative to the stain during a wash cycle.

20 Claims, 5 Drawing Sheets

(56) References Cited

U.S. PATENT DOCUMENTS

| | | | | |
|---|---|---|---|---|
| 6,032,495 | A * | 3/2000 | Leu | D06F 39/024 510/439 |
| 7,007,862 | B2 | 3/2006 | Chiang et al. | |
| 8,205,351 | B2 | 6/2012 | Howe et al. | |
| 8,312,746 | B2 * | 11/2012 | Perez-Toril Galan | D06F 43/002 68/200 |
| 2009/0185764 | A1 * | 7/2009 | Hsieh | D06F 95/006 383/86 |
| 2009/0307924 | A1 | 12/2009 | Aouad et al. | |
| 2010/0044370 | A1 | 2/2010 | Barthel et al. | |
| 2010/0281928 | A1 | 11/2010 | Martin | |
| 2015/0000048 | A1 * | 1/2015 | Miracle | C09B 29/0003 8/137 |

FOREIGN PATENT DOCUMENTS

| | | | |
|---|---|---|---|
| WO | WO-2009150423 | A1 | 12/2009 |
| WO | WO-2015192897 | A1 | 12/2015 |

OTHER PUBLICATIONS

International Application No. PCT/US2016/037502, International Preliminary Report on Patentability, dated Dec. 19, 2017.

* cited by examiner

LAUNDRY STAIN REMOVAL DEVICE

TECHNICAL FIELD

The present disclosure generally relates to stain removal devices and, more particularly, to stain removal devices incorporating water soluble materials.

BACKGROUND

Laundry cleaning and stain removal devices are generally known in the industry. One example of such a device is a unit dose device. One form of these devices are water-soluble pouches or pods which are filled with cleaning compositions or solutions such as powdered detergents, liquid rinse aids, fabric softeners, and the like. When using a washing machine to clean laundry, water used during the cleaning cycle dissolves the water-soluble pouch and releases the contents contained therein and thus fills the wash basin with the cleaning composition to assist in cleaning the laundry. The amount of cleaning composition contained in each water-soluble pouch typically corresponds to an amount needed for a single cleaning cycle.

These pouches are typically either placed directly into the wash basin prior to initiating the cleaning cycle or may be placed in a housing or shell prior to placing the unit in the wash basin. These shells generally include a number of holes which allow water to pass into the shell and thus contact the pouch to ultimately dissolve the same and allow its contents to disperse.

Articles of laundry may become soiled by a variety of different stains. Because the nature of each stain may be different, it is oftentimes difficult to effectively remove a stain from a fabric or an article of clothing. Further, when using water-soluble pouches disposed within the wash basin, performance of the cleaning composition is often diluted, thus the overall effectiveness of removing a localized stain may decrease. As a result, consumers may be forced to wash the stained article of laundry multiple times, thus using additional water and/or cleaning compositions. By repeatedly washing articles of laundry, costs incurred by consumers may increase. Further, the integrity of the article of clothing may decrease with each subsequent wash and/or cleaning cycle, and may be further decreased by rubbing, scuffing, and/or scrubbing the stained area to attempt to remove the stain.

SUMMARY

Generally speaking, pursuant to these various embodiments, the present disclosure is directed to a stain removal device which at least partly surrounds a stain located on a fabric to activate in a targeted manner. The device includes a shell which comprises a wall having an inner surface, an outer surface, and a rim defining an aperture in the shell, the rim being defined by the inner surface and the outer surface. The inner surface of the wall defines a shell cavity. At least one opening extends through the wall of the shell between or through the inner and outer surfaces of the shell. A dispensable cleaning agent is at least partially disposed within the shell cavity, and an attachment portion is at least partly coupled to the shell. The attachment portion is adapted or configured to removably couple the stain removal device to a fabric or article of clothing such that the rim of the shell contacts the fabric and at least partially surrounds a stain located on the fabric. So configured, the dispensable cleaning agent may activate in a targeted manner relative to the stain during a wash cycle.

In some embodiments, the shell may be formed in any number of shapes. For example, the shell may be generally spherical, hemispherical, tubular, cubical, conical, pyramidal, prismatic, or any combination of the same. Other examples are possible.

In some forms, the attachment portion includes at least one fastener configured to removably couple to the fabric. The fastener may be a number of magnets wherein a first magnet includes a first surface coupled to the attachment portion of the shell and a second surface, and a second magnet includes a surface. So configured, the second surface of the first magnet is adapted to removably couple to the surface of the second magnet such that the fabric is at least partially disposed between the surfaces of the magnets. In other forms, the fastener may be any combination of adhesives, components of a hook and loop fastener, hooks, zippers, clamps, buttons, snaps, friction-fit members, and/or threaded members. Other examples are possible.

In other forms, the shell may include a first removable section having a first attachment sub-portion coupled to the first removable section and a second removable section having a second attachment sub-portion coupled to the second removable section. The first removable section is configured to be disposed on a first side of the fabric, and the second removable section is configured to be disposed on a second side of the fabric. The first attachment sub-portion of the first removable section couples to the second attachment sub-portion of the second removable section. These two attachment portions may each comprise at least one fastener, for example, a magnet. Other examples of fasteners are possible.

In yet other examples, the at least one opening is configured to allow water to pass into and out of the shell cavity which may be used to contact the dispensable cleaning agent to assist in removing the stain from the fabric. In other examples, a plurality of openings may be provided on the shell to increase a centrifugal force experienced by the fabric during washing.

In some embodiments, the dispensable cleaning agent may comprise a pod which includes a water soluble film adapted to dissolve in a time-released manner. The pod may define a pod cavity containing a cleaning agent. Accordingly, the pod may be configured to control the release of the cleaning agent over a determined period of time.

In many approaches, the dispensable cleaning agent may include a flanged portion in contact with the rim of the shell, thereby being sandwiched between the shell and the fabric to restrict movement of the dispensable cleaning agent during use.

In other embodiments, a stain removal device includes a first and second shell adapted to be coupled together to form a generally spherical shape. The first shell has an inner and an outer surface and second shell has an inner and an outer surface are substantially hollow and define a shell cavity when coupled together and each have a plurality of holes disposed through each of the inner and outer surfaces of the first and second shells. A dispensable cleaning agent is provided which comprises a pod that includes a water soluble film adapted to dissolve in a time-released manner. The pod defines a pod cavity containing a stain removal formulation and is disposed in a portion of one of the shell cavities. A first and second magnet are removably coupled to the first and second shells, respectively. The first shell is configured to be disposed on a first side of a fabric during use and the second shell is configured to be disposed on a second side of the fabric during use. The second shell is removably coupled to the first shell via a magnetic force exerted between the first and second magnets such that the fabric is at least partially disposed between the first and second magnets.

In yet other examples, approaches for using a stain removal device having a first shell comprising a wall and forming a first shell cavity and having an inner surface, an outer surface, a rim defined by the inner surface and the outer surface, and at least one opening formed between the inner surface and the outer surface, and also having a dispensable cleaning agent, on a fabric are provided. The dispensable cleaning agent is first disposed within the first shell cavity. The first shell is then at least partly coupled to a fabric via an attachment portion such that the rim at least partially surrounds a stain located on the fabric. The dispensable cleaning agent then interacts with the fabric to assist in removing the stain therefrom. Water may be applied to the stain removal device such that the water enters at least one opening of the shell and contacts the dispensable cleaning agent to assist in removing the stain from the fabric.

In some of these approaches, coupling the first shell to the fabric includes securing the attachment portion to the fabric using a fastener. This may include placing a first magnet coupled to the first shell on a first side of the fabric and placing a second magnet on a second side of the fabric such that the fabric is at least partially disposed between the first and the second magnets. In many examples, the dispensable cleaning agent is secured to the first shell such that movement of the dispensable cleaning agent is restricted within the first shell.

In other embodiments, a second shell is provided which has a second attachment portion. The second shell is coupled to the first shell via the attachment portion of the first shell and the second attachment portion such that the stain is at least partially disposed between the first and second shells.

BRIEF DESCRIPTION OF THE DRAWINGS

The above needs are at least partially met through provision of the laundry stain removal device described in the following detailed description, particularly when studied in conjunction with the drawings, wherein.

Figure 1:
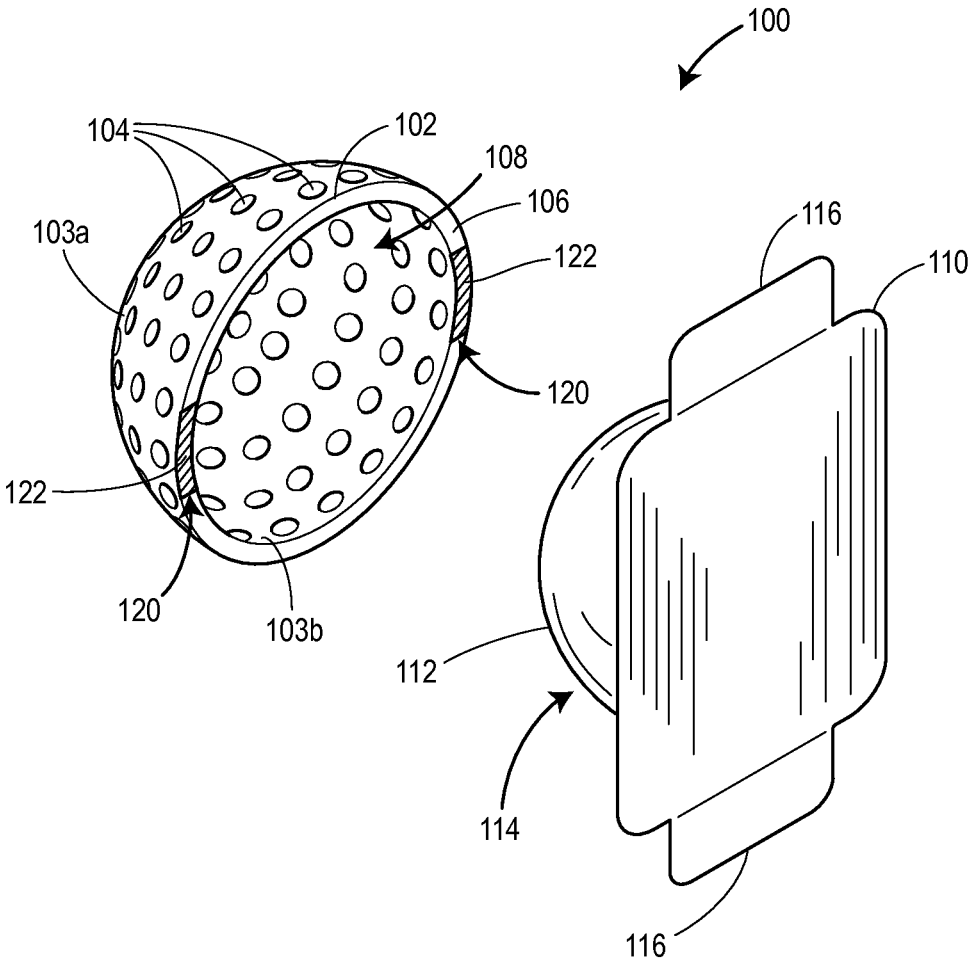
FIG. 1 comprises a perspective view of an example laundry stain removal device as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a laundry stain removal device is provided to assist in removing stains from soiled fabric such as articles of clothing, furniture, and the like. In one approach, the laundry stain removal device removably couples to the fabric to provide a localized cleaning solution thereto. The device may couple to the fabric via any number of apparatuses generally disposed within an attachment portion of the device. A dispensable cleaning agent is contained within the device to assist in removing the stain from the fabric. This cleaning agent may be at least partially encapsulated in a pod having a water soluble film that defines a cavity in which a stain removal formulation is contained. The device may have any number of holes which allow water or other liquid or flowable formulations to enter, thus contacting the dispensable cleaning agent. As a result, the dispensable cleaning agent may dispense and directly contact the stain. Further, the device avoids scuffing or otherwise damaging the fabric at the stained location, which may result in fewer unsightly portions of the fabric.

So configured, the stain may directly interact with a concentrated cleaning solution to efficiently remove the stain, thus reducing the number of wash cycles required to clean the fabric. Additionally, excess product will not be consumed; as each laundry stain removal device may be appropriately dimensioned for the desired stain size and/or stain type. The device may be reusable by simply removing it from one fabric and applying it to a subsequent fabric.

Referring now to the drawings, and in particular to FIGS. 1-4, a laundry stain removal device 100 is provided which may include a shell 102 having an outer surface 103*a*, an inner surface 103*b*, a number of openings or holes 104, a rim 106 defined by the outer surface 103*a* and the inner surface 103*b*, a shell cavity 108 formed by the inner surface, a dispensable cleaning agent 110, and an attachment portion 120.

The shell 102 may be constructed of a water-resistant, durable material such as a plastic, metal, rubber, or other suitable material and/or combination of materials. It is understood that the shell 102 may be constructed by any known method (e.g., extrusion, thermoforming, injection moulding, dip moulding, etc.) and thus details regarding manufacture will not be provided. The shell 102 is generally thin walled and hollow—that is, the shell 102 defines a shell cavity 108 or recess in which to dispose the dispensable cleaning agent 110. It is understood that in some forms, the shell 102 may be constructed from a semi-rigid or flexible material such that it maintains its general shape, and in other forms, the shell 102 may be constructed from a rigid material. The shell 102 may be provided in any number of shapes, such as, for example, spherical, hemispherical, tubular, cubical, conical, pyramidal, prismatic, and/or any combination of these shapes. Other shapes are possible.

The holes 104 may be disposed at various locations on the shell 102 and form an opening between the outer surface 103*a* and the inner surface 103*b*. It is understood that while the shell 102 illustrated in the provided figures includes a number of holes 104 disposed therethrough, any number of holes 104 may be provided. These holes 104 may be of any desirable shape and/or dimension, such as, for example, circular holes approximately ¼ inch to approximately one inch in diameter. Other sizes and shapes are possible. For example, the shell 102 may include right cylindrical sidewalls defining right cylindrical holes 104. In other versions, the shell 102 may define frustoconical sidewalls defining the holes 104 such that the holes 104 can act as nozzles, for example. Other examples are possible.

The dispensable cleaning agent 110 may be a pod which includes a water-soluble film 112 defining a cavity containing a stain removal formulation 114. The shape, size, and/or volume of the dispensable cleaning agent 110 may closely match the shape, size, and/or volume of the inner surface 103*b* and the shell cavity 108. In some examples, the pod may be configured to control the release of the stain removal formulation 114 over a period of time such as a standard wash cycle, multiple wash cycles, or a portion of a single wash cycle.

In some embodiments, the water-soluble film 112 may include a polyvinyl alcohol (PVOH) and acrylate resin (e.g., MonoSol M8630) and may have varying thicknesses. Dispensable cleaning agents and water-soluble films are generally known to those of skill in the art, and thus will not be discussed in substantial detail. The dispensable cleaning agent 110 may optionally include any number of flanges 116 configured to secure the dispensable cleaning agent 110 within the shell 102 and restrict movement of the dispensable cleaning agent 110 when contained therein. For example, the pod may have an approximately 1-15 mm flange 116 used to restrict its movement. Other examples and dimensions are possible. When the shape and size of the dispensable cleaning agent 110 closely match the shape and size of the shell cavity 108, the flanges 116 may contact the rim 106 of the shell 102 to further restrict movement of the dispensable cleaning agent 110 relative to the shell cavity 108. Accordingly, in these examples, when the shell 102 is removably coupled to a fabric during use, the flange or flanges 116 may be positioned between the rim 106 and the fabric to limit its movement and thus limiting movement of the dispensable cleaning agent 110.

In some approaches where the pod is shaped to closely match the shape of the shell 110, the pod may be, for example, spherical, hemispherical, tubular, cubical, conical, pyramidal, and/or prismatic. Other configurations are possible including those where the pod lacks any flange.

The stain removal formulation 114 may be contained within any number of compartments within the cavity of the water-soluble film 112 and may include any number of different formulations used to clean a fabric 130 and/or remove a stain therefrom. In some examples, the stain-removal formulation 114 includes a two part formulation having a powder configured to first contact the stained area and a liquid used to further clean the stained area. Other configurations are possible. These formulations may be separated by any type of film and/or other material such as a PVOH film which may provide a controlled release of one or any number of formulations.

The attachment portion 120 is coupled to the shell 102 and may include at least one fastener 122. It is understood that any number of fasteners 122 may be coupled to the shell 102. As illustrated in the figures, the attachment portion 120 is generally located on the rim 106 of the shell 102, though other locations are possible (e.g., on the inner and/or outer surfaces 103*b*, 103*a* of the shell 102). In the embodiments illustrated in FIGS. 1-4, the fastener 122 consists of at least one magnet, which may include a first and second surface. As illustrated in FIG. 1, the magnet or magnets may be recessed in the shell 102 and entirely encapsulated such that they are not visible, however, in other embodiments such as those illustrated in FIGS. 5 and 6, the magnet or magnets may be disposed on rim 106 of the shell 102 such that it protrudes a distance therefrom. In yet other examples, the magnet or magnets may be simply inserted into a recess in the shell 102 and are held in place by any number of methods and/or components such as, for example, gluing or other adhesives, friction-fitting, and the like. Other configurations are possible. So configured, the first surface of the magnet is coupled to the attachment portion of the shell.

Figure 2:
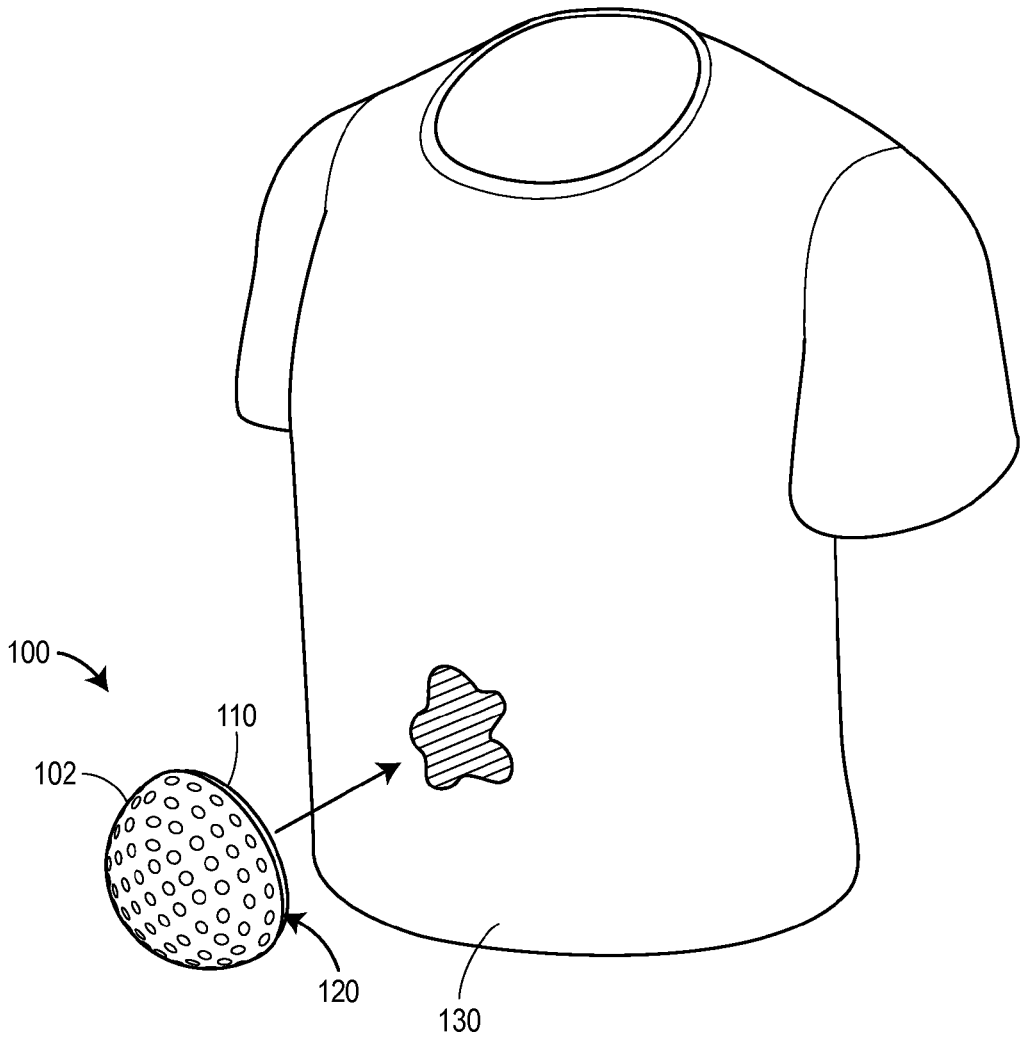
FIG. 2 comprises an illustration of a stained article of clothing having the laundry stain removal device of FIG. 1 being applied thereto as configured in accordance with various embodiments of the invention.
Figure 3:
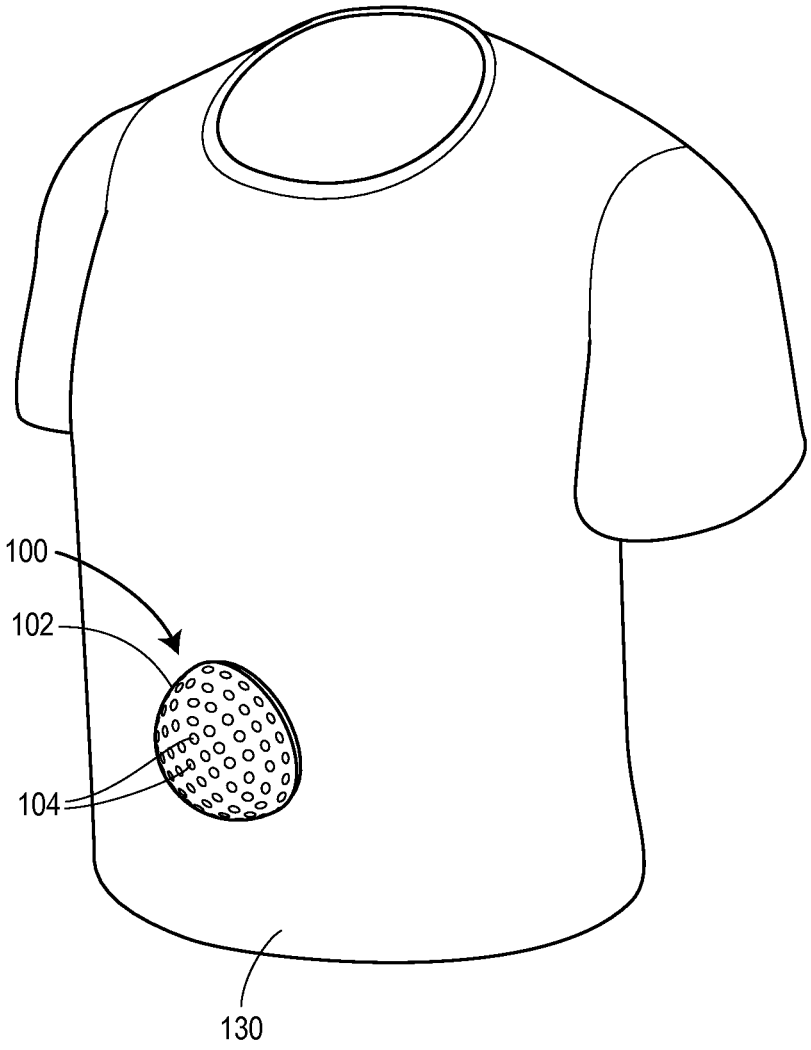
FIG. 3 comprises an illustration of the stained article of clothing with the laundry stain removal device applied thereto as configured in accordance with various embodiments of the invention.
Figure 4:
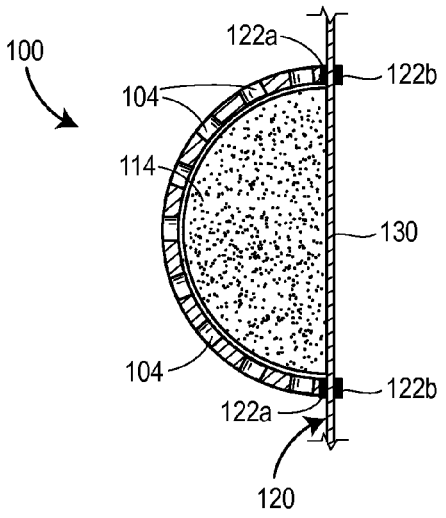
FIG. 4 comprises a cross-sectional view of the stain removal device when applied to a fabric and/or article of laundry as configured in accordance with various embodiments of the invention.

In operation and as illustrated in FIGS. 2-4, a user places the dispensable cleaning agent 110 in the cavity of the shell 102. The user may then couple the shell to the fabric 130 using the attachment portion 120 such that the rim 106 at least partially surrounds a stain located on the fabric 130 as depicted in FIG. 3. So configured, the dispensable cleaning agent 110 may activate in a targeted manner relative to the stain on the fabric 130 during a wash cycle.

In embodiments in which the fasteners 122 include a number of magnets (for example, as illustrated in FIG. 4), a first magnet 122*a* (e.g., the magnet coupled to the shell 102) is placed on a first side of the fabric 130 and a second magnet 122*b* is placed on a second side of the fabric 130. In other words, as illustrated in FIG. 4, the fabric is at least partially disposed between the magnets 122*a*, 122*b*, and the second surface of the first magnet 122*a* is removably coupled to a surface of the second magnet 122*b*. So configured, the dispensable cleaning agent 110 maintains direct or close removable contact with the stain contained on the fabric 130.

In some examples, the fabric 130 and the stain removal device 100 are placed in a conventional washing machine. During the wash cycle, water may enter through the holes 104 and contact the dispensable cleaning agent 110 such that the film 112 dissolves and the stain-removal formulation 114 is released onto the stain on the fabric 130. When combined with the agitation cycle provided during a typical wash, the stain removal device 100 may provide a localized dispersion of product at high concentrations to effectively remove the stain from the fabric 130. As such, the stain removal device 100 may remove a stain using the dispensable cleaning agent 110 in a targeted manner.

It will be understood that in some examples, the dispensable cleaning agent 110 may not require the use of water, but rather water vapour or steam, to release the stain-removal formulation 114 onto the fabric 130. For example, it is possible that agitation during a "steam" or "dry-cleaning" cycle in which steam is used may be sufficient to cause the film 112 to dissolve and/or rupture to release the stain-removal formulation 114.

Figure 5:
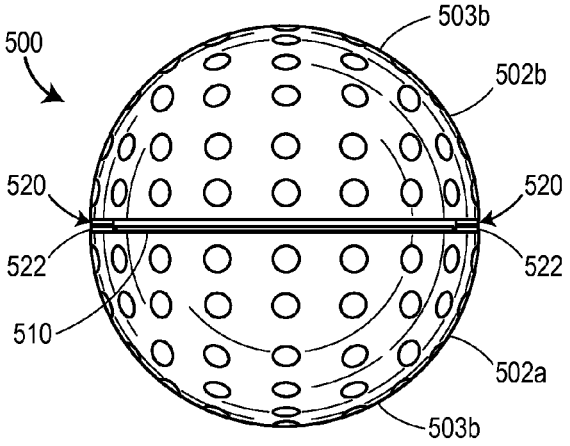
FIG. 5 comprises a side elevation view of an alternate laundry stain removal device having first and second removable sections as configured in accordance with various embodiments of the invention.
Figure 6:
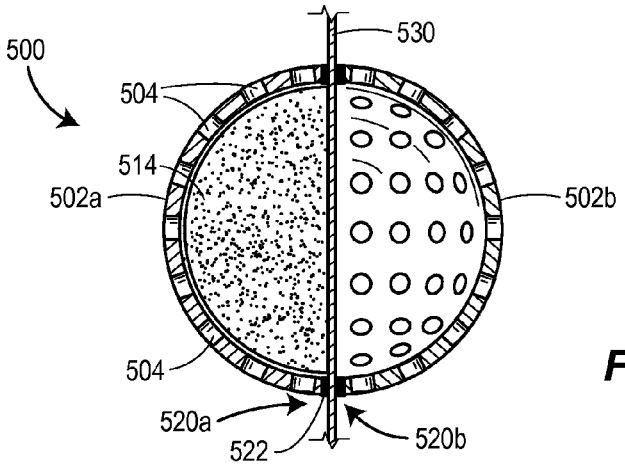
FIG. 6 comprises a cross-sectional view of the laundry stain removal device of FIG. 5 when applied to an article of fabric and/or laundry as configured in accordance with various embodiments of the invention.

Turning to FIGS. 5 and 6, an alternate laundry stain removal device 500 is provided. It will be understood that reference characters having the same two-digit suffixes (e.g., hole or holes 504) as previously described reference characters (e.g., hole or holes 104) represent similar elements and will not be discussed in substantial detail. In the alternate laundry stain removal device 500, the shell includes a first removable section 502*a* having an inner surface (not shown) and an outer surface 503*b*, and a second removable section 502*b* having an inner surface (not shown) and an outer surface 503*b*. In these examples, both the first and second removable sections 502*a*, 502*b* include an attachment portion 520*a*, 520*b* removably coupled to the first and second removable sections 502*a*, 502*b* in any of the disclosed manners. The first and second removable sections 502*a*, 502*b* may each have any number of holes 504 disposed through their first and second surfaces, and each may include a shell cavity for disposing a dispensable cleaning agent 510 therein. It will be understood that in some examples, only one of the two shell cavities may be used to dispose a dispensable cleaning agent 510 therein, and in other examples, both of the two cavities may be used to dispose a dispensable cleaning agent 510 therein to provide for an even greater concentration of stain-removal formulation 514 targeting the stain.

In operation, the first removable section 502*a* may be disposed on a first side of the fabric 530 (e.g., the outside of the fabric) and the second removable section 502*b* may be disposed on a second side of the fabric 530 (e.g., the opposite or inside of the fabric). The attachment portion 520*a* of the first removable section 502*a* is configured to couple to the attachment portion 520*b* of the second removable section 502*b*. In some examples, each of the attachment portions 520*a*, 520*b* includes at least one fastener and is configured to couple to the other in any manner, for example, by a magnetic force exhibited by a number of magnets. As such, the fabric 530 is configured to be at least partially disposed between (e.g., sandwiched between) the first and the second removable sections 502*a*, 502*b*.

In some embodiments, two or more pods may be used, each having a different stain-removal formulation. These pods may have identical or different films to control the rate in which the stain-removal formulation is released to the fabric. The stain-removal formulations in the two or more pods may serve different purposes during the cleaning process, for example, one stain-removal formulation may be configured to oxidize the targeted area and a second stain-removal formulation may be configured to assist in rinsing the targeted area. In some examples, one of the two or more pods may be disposed on each side of the fabric (e.g., one may be disposed within the first removable section 502*a* of FIG. 5, and the second may be disposed within the second removable section 502*b*). Alternatively, the two or more pods may both be disposed in one of the removable sections. Other configurations are possible.

In further examples, only one of the first or second removable sections 502*a*, 502*b* may have holes 504, while the other of the two sections is solid. So configured, the removable section without holes may retain water and thus improve the stain removal capabilities of the device 500 by allowing the stain to soak for extended periods. Other configurations are possible.

Figure 7:
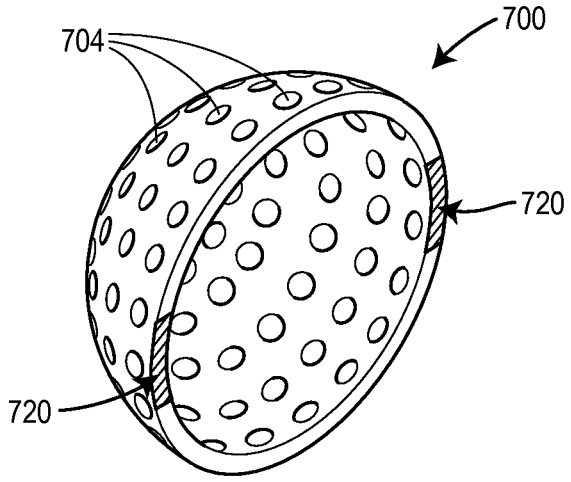
FIG. 7 comprises a perspective view of an alternate laundry stain removal device having different fasteners for securing to the fabric as configured in accordance with various embodiments of the invention.
Figure 8:
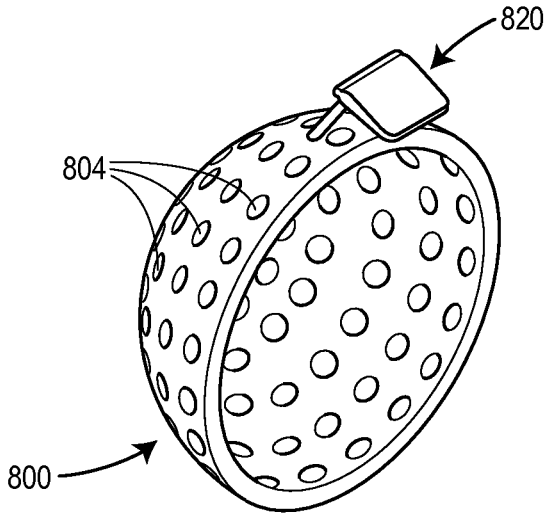
FIG. 8 comprises a perspective view of an alternate laundry stain removal device having a different clipping fastener for securing to the fabric as configured in accordance with various embodiments of the invention.

Turning to FIGS. 7 and 8, alternate laundry stain removal devices 700, 800 are provided. It will be understood that reference characters having the same two-digit suffixes (e.g., hole or holes 704 and 804) as previously described reference characters (e.g., hole or holes 104) represent similar elements and will not be discussed in substantial detail. As illustrated in these figures, the attachment portions 720, 820 may include any number of fasteners used to couple to the fabric (not shown). For example, as illustrated in FIG. 7, an adhesive fastener 720 such as Velcro or double-sided tape may be used. Alternatively, as illustrated in FIG. 8, a fastener 820 may comprise a hook having a resilient force used to clamp or pinch a fabric may be provided. In other examples (not illustrated), the fastener may be any number of hooks, zippers, clamps, buttons, and/or friction-fit or threaded members. Other configurations may be used.

In yet other examples, approaches for using a stain removal device having a first shell forming a first shell cavity and having an inner surface, an outer surface, a rim defined by the inner surface and the outer surface, and with at least one opening formed between the inner surface and the outer surface, and a dispensable cleaning agent, on a fabric are provided. The dispensable cleaning agent is first disposed within the first shell cavity. The first shell is then coupled to a fabric via an attachment portion such that the rim at least partially surrounds a stain located on the fabric. The dispensable cleaning agent then interacts with the fabric to assist in removing the stain therefrom. Water may be applied to the stain removal device such that the water enters at least one opening of the shell and contacts the dispensable cleaning agent to assist in removing the stain from the fabric.

In some of these approaches, coupling the first shell to the fabric includes securing the attachment portion to the fabric using a fastener. This may include placing a first magnet coupled to the first shell on a first side of the fabric and placing a second magnet on a second side of the fabric such that the fabric is at least partially disposed between the first and the second magnets. In many examples, the dispensable cleaning agent is secured to the first shell such that movement of the dispensable cleaning agent is restricted within the first shell.

In other embodiments, a second shell is provided which has a second attachment portion. The second shell is coupled to the first shell via the attachment portion of the first shell and the second attachment portion such that the stain is at least partially disposed between the first and second shells.

In some of these embodiments, a first shell and a second shell are provided which are adapted to be coupled together to form a generally spherical shape. These shells may be substantially hollow and define a shell cavity when coupled together and have any number of holes disposed thereon. A dispensable cleaning agent such as a pod is further provided and may include a water soluble film defining a pod cavity containing a stain removal formulation. The pod may be disposed in a portion of the shell cavity. The water soluble film is configured to release the stain removal formulation in a time-released manner. Further, a first magnet disposed on the first shell and a second magnet disposed on the second shell may be provided. The first shell is configured to be disposed on a first side of a fabric during use, and the second shell is configured to be disposed on a second side of the fabric during use. The second shell is removably coupled to the first shell via a magnetic force exerted between the first and second magnets such that the fabric is at least partially disposed between the two magnets.

So configured, the disclosed embodiments advantageously provide a targeted stain removal device which may effectively remove a stain from a fabric. The device may be reusable by inserting a new dispensable cleaning agent into the shell and coupling the shell to the fabric. Different dispensable cleaning agent formulations may be used to remove the stain from the fabric depending on the type of stain. Further, additional dispensable cleaning agents may be inserted into a second removable shell section to further increase the amount of cleaning formulation in contact with the stain. As such, cleaning efficiency may be greatly increased and the use of too much cleaning product may be reduced.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A stain removal device adapted to at least partially surround a stain located on a fabric to activate in a targeted manner, the device comprising:

a shell comprising a continuous wall having an inner surface, an outer surface, and a rim defining an aperture in the shell at an end of the wall, the rim transversely spanning an entire length between the inner surface and the outer surface and having a generally flat, planar configuration, the inner surface of the shell defining an entire interior volume of a constant volume shell cavity;

at least one opening extending through the wall of the shell between the inner surface and the outer surface;

a dispensable cleaning agent at least partially disposed within the shell cavity; and a generally planar attachment portion positioned at the rim at least partly coupled to the shell and defining an attachment surface extending between the inner surface and the outer surface of the shell, the attachment portion being configured to removably couple the stain removal device to a fabric such that the rim of the shell contacts the fabric and at least partially surrounds a stain located on the fabric while maintaining the fabric in a generally flat and planar orientation;

wherein in operation, the shell cavity that accommodates the dispensable cleaning agent maintains a constant volume.

2. The stain removal device of claim 1, wherein the attachment portion comprises at least one fastener configured to removably couple to the fabric.

3. The stain removal device of claim 2, wherein the at least one fastener comprises a first magnet and a second magnet, the first magnet including a first surface and a second surface, the first surface being coupled to the attachment portion of the shell, the second magnet being adapted to removably couple to a surface of the second magnet such that a fabric may be disposed between the second surface of the first magnet and the surface of the second magnet.

4. The stain removal device of claim 1, wherein the shell comprises a first removable section and a second removable section, and the attachment portion comprises a first attachment sub-portion coupled to the first removable section and a second attachment sub-portion coupled to the second removable section, the first removable section configured to be disposed on a first side of the fabric and the second removable section configured to be disposed on a second side of the fabric such that the first attachment sub-portion of the first removable section couples to the second attachment sub-portion of the second removable section.

5. The stain removal device of claim 4, wherein each of the first and second attachment sub-portions comprises at least one fastener.

6. The stain removal device of claim 2, wherein the fastener is selected from a group consisting of:

(a) an adhesive,
(b) a component of a hook and loop fastener,
(c) a hook,
(d) a zipper,
(e) a clamp,
(f) a button,
(g) a snap,
(h) a friction-fit member, and
(i) a threaded member.

7. The stain removal device of claim 1, wherein the at least one opening comprises a plurality of openings extending through the wall of the shell to allow water to pass into and out of the shell cavity.

8. The stain removal device of claim 1, wherein the shell has a shape selected from the group consisting of:

(a) spherical,
(b) hemispherical,
(c) tubular,
(d) cubical,
(e) conical,
(f) pyramidal, and
(g) prismatic.

9. The stain removal device of claim 1, wherein the dispensable cleaning agent comprises a pod including a water soluble film defining a pod cavity containing a cleaning agent.

10. The stain removal device of claim 1, wherein the dispensable cleaning agent includes a flanged portion in contact with the rim of the shell, thereby being sandwiched between the shell and the fabric to restrict movement of the dispensable cleaning agent during use.

11. A method of using a stain removal device comprising a) a shell comprising a continuous wall and having an inner surface, an outer surface, a generally flat, planar rim defining an aperture in the shell at an end of the wall the rim transversely spanning an entire length between the inner surface and the outer surface, the inner surface defining a first shell cavity, and b) at least one opening extending through the wall of the shell between the inner surface and the outer surface, and a dispensable cleaning agent, on a fabric, the method comprising:

disposing the dispensable cleaning agent at least partially within the first shell cavity such that the disposable cleaning agent is free to contact the entire inner surface of the cavity; and at least partly coupling the shell to a fabric via a generally planar attachment portion positioned at the rim such that the rim of the shell contacts the fabric and at least partially surrounds a stain located on the fabric while maintaining the fabric in a generally flat and planar orientation, and the dispensable cleaning agent interacts with the fabric to assist in removing the stain therefrom, wherein in operation, the first shell cavity that accommodates the dispensable cleaning agent maintains a constant volume.

12. The method of claim 11, wherein coupling the shell to the fabric comprises securing the attachment portion to the fabric using at least one fastener.

13. The method of claim 12, wherein securing the attachment portion to the fabric comprises placing a first magnet coupled to the shell on a first side of the fabric and placing a second magnet on a second side of the fabric such that the fabric is at least partially disposed between the first magnet and the second magnet.

14. The method of claim 11, further comprising securing the dispensable cleaning agent to the shell such that movement of the dispensable cleaning agent is restricted within the first shell.

15. The method of claim 11, wherein the shell comprises a first removable section and a second removable section, the method further comprising:

providing an attachment portion comprising a first attachment sub-portion coupled to the first removable section and a second attachment sub-portion coupled to the second removable section; and coupling the second removable section to the first removable section via the second attachment sub-portion of the second removable section and the first attachment portion of the first removable section such that the stain is at least partially disposed between the first removable section and the second removable section.

16. The method of claim 11, further comprising the step of applying water to the stain removal device such that the water enters the at least one opening of the shell and contacts the dispensable cleaning agent to assist in removing the stain from the fabric.

17. A stain removal device comprising:

a first shell having an inner and an outer surface and a second shell having an inner and an outer surface adapted to be coupled together to form a generally spherical shape, the first shell and the second shell being substantially hollow and defining a respective first shell cavity and second shell cavity and further defining a device shell cavity when coupled together, each of the first shell and the second shell having a plurality of holes disposed through each of the inner and outer surfaces;

a dispensable cleaning agent comprising a pod including a water-soluble film adapted to dissolve in a time-released manner, the pod defining a pod cavity containing a stain removal formulation, wherein the dispensable cleaning agent is adapted to be disposed in a portion of one of the first shell cavity or the second shell cavity; and a first generally planar magnet removably coupled to the first shell and a second generally planar magnet removably coupled to the second shell, wherein the first shell is adapted to be disposed on a first side of a fabric during use, and the second shell is adapted to be disposed on a second side of the fabric during use, the second shell being removably coupled to the first shell via a magnetic force exerted between the first magnet and the second magnet such that the fabric is at least partially disposed between the first magnet and the second magnet and maintained in a generally flat and planar orientation, wherein in operation, the first shell cavity that accommodates the dispensable cleaning agent maintains a constant volume.

18. The stain removal device of claim 1, wherein the interior volume of the device cavity is dimensioned to accommodate the dispensable cleaning agent.

19. The stain removal device of claim 1, wherein when the fabric is coupled to the stain removal device, the dispensable cleaning agent is free to contact an entirety of the inner surface of the shell prior to contacting the fabric.

20. The stain removal device of claim 1, wherein when the fabric is coupled to the stain removal device, the at least one opening allows water to passively enter into the device cavity to first contact the dispensable cleaning agent to assist in removing the stain located on the fabric.

* * * * *